United States Patent [19]

Simon

[11] 4,102,070

[45] Jul. 25, 1978

[54] FLIP CARD DISPLAY

[75] Inventor: Virgil S. Simon, Glenview, Ill.

[73] Assignee: Thomas A. Schutz Co., Inc., Morton Grove, Ill.

[21] Appl. No.: 693,636

[22] Filed: Jun. 7, 1976

[51] Int. Cl.[2] ..... G09F 11/06

[52] U.S. Cl. ..... 40/498; 40/535; 40/531

[58] Field of Search ..... 40/35, 52 R, 53 R, 53 A, 40/97, 98, 104 R, 104 A, 68, 102, 33, 36, 72, 68.6, 68.4, 104.17; 220/22.2, 22.3; 312/186

[56] References Cited

U.S. PATENT DOCUMENTS

| | | | |
|---|---|---|---|
| 618,600 | 1/1899 | Colclazer et al. | 40/97 |
| 1,746,581 | 2/1930 | Dolar | 40/35 |
| 2,130,428 | 9/1938 | Katz | 40/35 |
| 2,458,657 | 1/1949 | Torrence et al. | 40/35 |
| 2,554,941 | 5/1951 | Dobrowsky | 40/35 |
| 3,285,249 | 11/1966 | Rael | 40/102 |
| 3,964,428 | 6/1976 | Arai | 40/68 |

FOREIGN PATENT DOCUMENTS

| | | | |
|---|---|---|---|
| 737,720 | 7/1966 | Canada | 40/104.17 |
| 939,069 | 10/1963 | United Kingdom | 40/35 |

*Primary Examiner*—Samuel W. Engle
*Assistant Examiner*—Ralph Palo
*Attorney, Agent, or Firm*—Wegner, Stellman, McCord, Wiles & Wood

[57] ABSTRACT

A display device is provided with a plurality of flip display cards which are pivotally carried by a rotatable card holer. A release tab is positioned above the card holder so as to engage the edge of one card whereby the information on the front of said one card can be viewed. The preceding card is supported on abutments on the card holder so that information on the back of said preceding card can be viewed simultaneously with the information on the front of said one card. The card holder is turned step-by-step so as to urge the one card past a first viewing position whereupon the card falls down onto the abutments for viewing in the second viewing position as the next card is moved into said first viewing position. The card holder has structure for pivotally carrying display cards, abutments for supporting display cards and indexing detents for providing the step-by-step advance of the display cards.

8 Claims, 5 Drawing Figures

FLIP CARD DISPLAY

BACKGROUND OF THE INVENTION

1. Field of the Invention

This invention relates to display devices and, more particularly, to flip card point of sale displays.

2. Description of the Prior Art

A common type of point of sale display device making use of flip cards has a hinge, such as a ring binder, along one edge of a plurality of display cards so that successive cards can be flipped into viewing position. The device is difficult to keep in a standing position particularly during the flipping of a card and, in order to view the front of one card and simultaneously the back of another card, it is necessary to hold the one card up thereby making it impossible to use that hand for other sales demonstrating purposes.

Other types of flip card displays are available with stands whereby only one card is viewed at a time as the cards are flipped. And still another flip display uses mechanical means to advance a card past a viewing station one at a time. All of the prior devices fail to provide a structure for vertically displaying information on one card with the preceding card held in position for displaying information on the reverse side of said card.

SUMMARY OF THE INVENTION

A point of display flip card device is provided whereby a shaft is turned to flip one card into a position where the front side of said card and the back side of a preceding card are simultaneously visible. The device includes a card holder whereby a plurality of cards are pivotally held to the end portions of the holder, and abutment means are provided between adjacent cards to engage with and support one of said adjacent cards. The holder includes indexing detents for holding the card holder in a stationary indexed position until the shaft is turned. When the holder is in an indexed position, one card projects upward and may engage with a tab on the cabinet which tab restrains the card against falling forward. The upper viewing card is the card whose front portion is visible for examination. When the knob is turned, the upper viewing card will snap past the tab and fall forward against the abutments on the holder whereby the rear of that card is visible along with the front of the next card which is now held in the upper viewing position by the tab.

The improved point of display device leaves the hands of the user free to demonstrate the product while the information on the two visible cards is viewed in conjunction therewith. A short turn of the knob of the display snaps the upper viewing card past the release tab as the next card is moved into the upper viewing position. The previous upper viewing card falls down against the abutments to expose the information on the back of the card for viewing.

The device is relatively simple in design, requiring no expensive parts, is easy to operate, is positive in action and is effective in use.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 4 is a perspective view of the card holder removed from the flip card device; and FIG. 5 is a sectional view of the right-hand end disc with display cards therein as it is advanced from one position to the next.

DESCRIPTION OF THE PREFERRED EMBODIMENT

Figure 2:
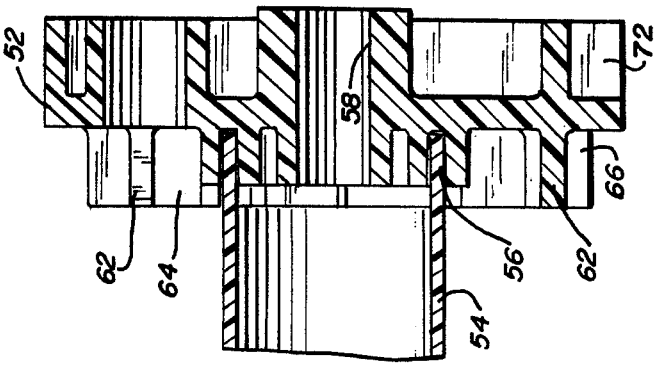
FIG. 2 is a cross-sectional view taken along the line 2—2 of FIG. 3.

In the drawings, a display stand 10 is illustrated and comprises a product display portion 12 and a flip card display portion 14. Although the flip card display portion 14 is shown in a common stand 10 with the product display 12, it is to be understood that the flip card display 14 could be mounted in its own cabinet or could be mounted as part of any number of other types of displays.

The display stand 10 is comprised of an open front rectangularly shaped cabinet 16 with a bottom section 18 that extends forward from an overhanging top portion 20. The cabinet 16 is divided into the two portions 12 and 14 by a common wall 22 with the product display portion 12 containing shelves 24, and the like, upon which the different products, that are being sold, are mounted. A tapered transparent window 26 covers the product display portion 12 with access to the product display portion being obtained through the rear of the cabinet 16.

The other portion 14 of the cabinet 16 is devoted to a novel flip card display device 30 which contains the invention herein disclosed. The card display portion 14 of the cabinet 16 has a downwardly depending overhanging wall 32 which combines with the spaced side walls 22,34 to form an upper viewing opening 36 in the front of the cabinet 16. The bottom section 18 has a forwardly and downwardly tapered upper part which terminates at the top edge of a front wall 38 to define an angled opening 40 which combines with said upper viewing opening 36 to form the display opening for the flip card display.

An actuator rod 42 extends through the two side walls 34,22 of the portion 14 with the one end portion 44 of the rod 42 being mounted in an opening in wall 22 for rotation about its longitudinal axis. The other end portion 46 of the rod 42 extends outwardly through the side wall 34 of the housing and has an actuator knob 48 keyed thereto. A pair of discs 50,52, preferably molded of plastic material, are mounted onto the actuator rod 42 and are spaced apart a predetermined amount by a hollow tubular spacer sleeve 54 seated at each end portion in recesses 56 formed in the facing portions of the discs. The rod 42, in the vicinity of the discs 50,52, and the center opening 58 of the discs 50,52 are square in shape, as shown in FIGS. 4 and 5, so as to key the rod 42 and discs 50,52 together for simultaneous rotation. Any form of keying between the rod 42 and discs 50,52 are acceptable. The discs 50,52 are spaced apart by a spacer sleeve 54 and are mounted between the walls 22,34 by rod 42 ready for turning, all as shown best in FIG. 1.

The discs 50,52 each have identical parts, but the inwardly facing parts of one is a mirror image of the other. Only one disc, namely disc 52, will be described in detail. Disc 52 contains a plurality of openings 60 which, in the form illustrated, are nine in number. Each opening 60 in disc 52 is aligned with a comparable opening 60 in disc 50. Between each adjoining circumferentially spaced pair of openings 60 is formed a shaped abutment 62 which has two intersecting planar portions 64,66 with planar portion 64 being a short portion lying in a plane passing through the center of the opening 60 adjoining said portion 64. Planar portion 66 is a long portion and lies in a plane which passes through the center of the next clockwise adjacent opening 60, as viewed in FIG. 5, and lies perpendicular to the plane containing the short portion 64 of said abutment of the next clockwise adjacent opening 60. As shown, the long portion 66 of one abutment 62 forms a right angle with the short portion 64 of the next clockwise adjacent abutment 62. It is to be understood that the angled relationship between the long and short portions 66,64 of the abutments 62 may be varied to produce different angled relationships between the display cards 70 as will be more apparent hereinafter. Each abutment 62 on each disc 50,52 has a mating and aligned abutment 62 on the opposite disc so that a plane passing through the surface portions 64,66 of the abutment 62 on one disc 52 will pass through the surface portions 64,66 of the comparable abutment 62 on the other disc 50. As can be seen in FIGS. 2 and 4, the abutments 62 project into the open area between the spaced discs 50 and 52.

On the outer periphery of the discs 50,52 and on a part axially spaced from the abutments 62 is formed a plurality of indexing members or detents 72, each detent 72 has one wall 74 lying substantially in a plane intersecting the center of the disc with another wall 76 formed at an acute angle thereto. The number of detents 72 equals the number of openings 60 and the number of abutments 62 on each disc. A cantilever-type spring 80 is secured by screws 82 to the wall 34 of the cabinet 16 and has a shaped end portion 84 nesting in one of the detents 72. The spring 80 could be mounted on the wall 22 to engage the detents 72 in the disc 52 without departing from the spirit of the invention. The detents 72 are positioned in the discs 50,52 in a particular orientation with respect to the abutments 62 and the openings 60 for a purpose to be disclosed hereinafter.

Each display card 70 has a pair of outwardly extending ears 86 along one edge portion thereof which ears 86 are inserted in one pair of aligned openings 60 in the discs 50,52. The assembly of the card to the card holder is accomplished by bowing the display card 70 between the ears 86 and threading the ears 86 into the aligned openings 60. Upon release of the card 70, the card will straighten out and seat the ears 86 in the openings 60. The card 70 will now be free to pivot about the ears 86 between a position engaging the short portion 64 on one abutment 62 or the long portion 66 on the adjacent abutment 62. A display card 70 is assembled in each pair of aligned openings 60. The discs 50,52 and spacer 54 form a display card holder 90.

Figure 1:
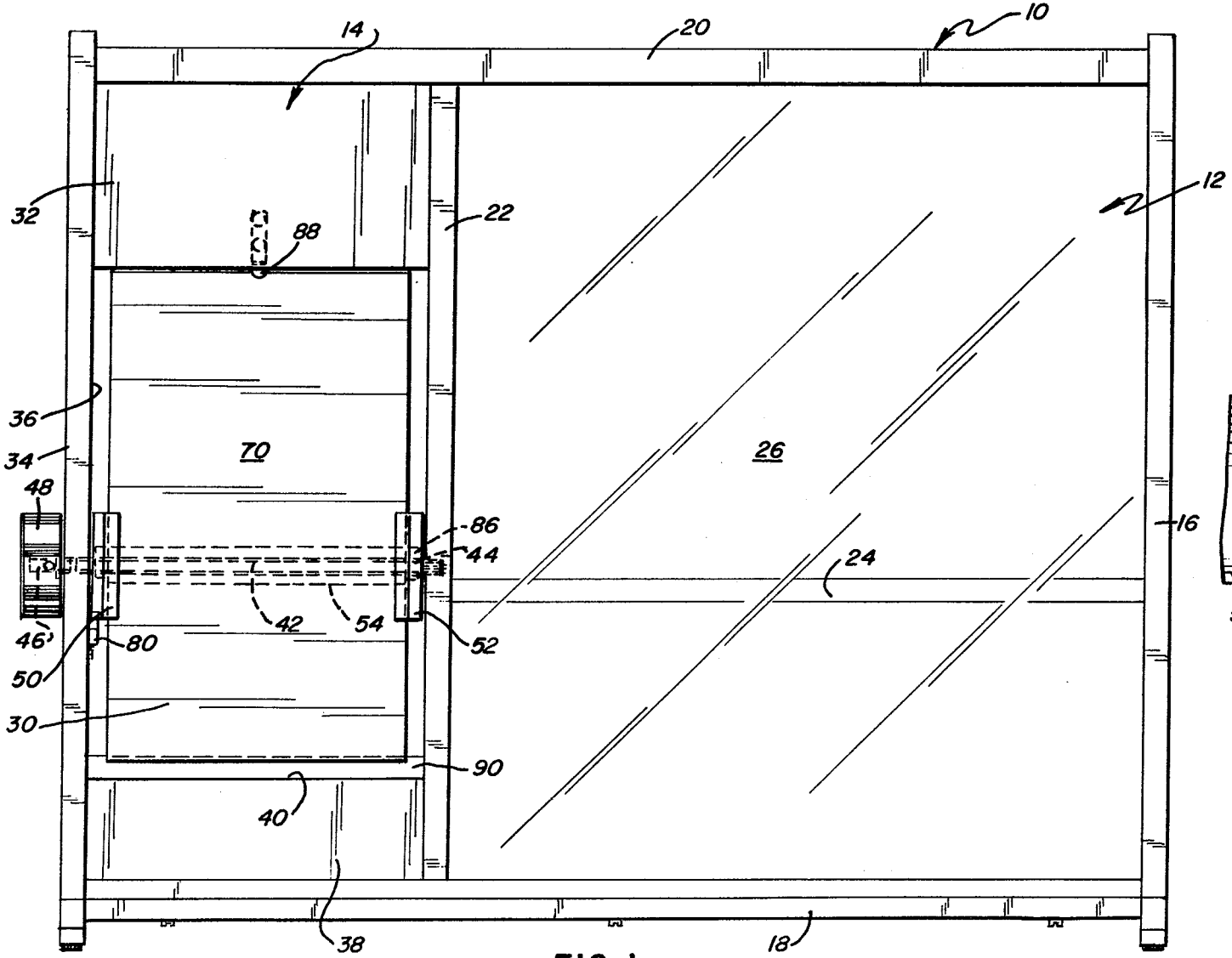
FIG. 1 is a front elevational view of a display stand incorporating the improved flip card device.
Figure 3:
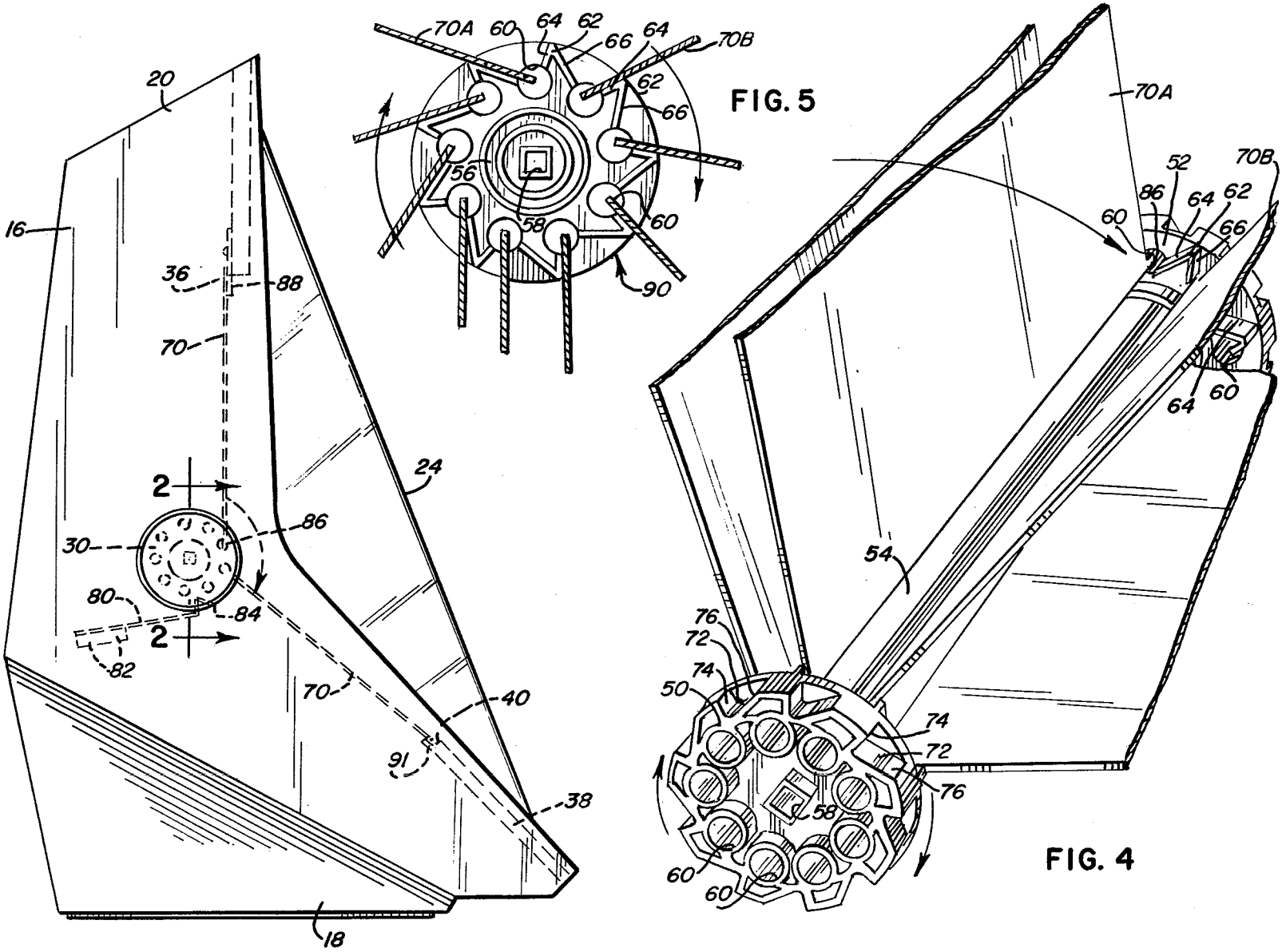
FIG. 3 is an end view of the device of FIG. 1.

As shown in FIGS. 1 and 3, a tab 88 is secured to the wall 32 and overlaps the upper viewing opening 36. With the cards 70 and card holder 90 in the cabinet 16, as shown in FIG. 3, one card 70 will be in a substantially vertical plane with the long portions 66 of one pair of aligned abutments 62 bearing against the rear of the card to urge the top edge of the card against the tab 88 on the cabinet 16 for viewing of the front of the card in the upper viewing opening 36. The next clockwise adjacent preceding card 70 is positioned with the front lower edges of the card bearing against a pair of aligned short portions 64 of the adjacent pair of abutments 62 so as to suspend the card 70 in the angled or second viewing opening 40 in the lower tapered portion of the cabinet 16. The edge of the said adjacent card remote from the ears 86 may be supported on an upwardly extending ledge 91 formed on front wall 38. The ledge 91 serves the function of holding the cards flat to prevent drooping or warping of the cards due to being supported a long period of time by only the portions 64 of the abutments. The remaining cards 70 are in various states of suspension from their openings 60 and from the engagement with the long and short portions 66,64 of the various abutments 62 within the compartment. To change the display, the top of knob 48 is turned toward the front of the cabinet 16 a few degrees which will cause the radial wall 74 of the detent 72 to raise the end 84 of the spring 80. As the knob 48 is turned further, the vertical card 70 will snap past the tab 88 due to the cantilever-type pressure placed against the rear of the card by the long portions 66 of the abutment 62. Continued turning of the knob 48 will raise the next display card 70 toward the vertical opening 36 as the end 84 of the spring 80 slides onto the tapered wall 76 of the detent 72. The force of the spring 80 on the tapered wall 76 will advance the card holder 90 to a position with said next card 70 pressed against the tab 88 in the vertical position for viewing through vertical opening 36. The radical wall 74 of the detent 72 is oriented relative to the vertical position of the card 70 in the vertical opening to apply just the right amount of pressure to the card to hold it firmly against the tab 88. The preceding card will fall forward and pivot around the ears 86 until the back of the card bears against the short portion 64 of the clockwise adjacent abutment 62 whereupon said card is suspended in the angled opening 40 for viewing of the contents on the back of said card. Each time it is desired to advance a card, the knob 48 is grasped and turned a few degrees clockwise whereupon the vertical card will be snapped past the tab 88 and will fall forward into position in the angled opening 40 in the lower portion of the cabinet 16 with the next succeeding card 70 being raised into engagement with the tab 88 for viewing in the vertical opening of the cabinet 16.

More or less numbers of openings 60, abutments 62, and detents 72 may be provided to increase or decrease the number of display cards 70 presented in a particular presentation. It is important to recognize that the relationship between the long and short portions 66,64 of the abutments 62, the detents 72 and the openings 60 is important in order to have the appropriate display card 70 in the vertical opening 36 and against the tab 88 with the preceding card in a position in the lower angle opening 40 of the housing. Different angular relationships can be established for the walls of the abutments 62 whereby the angled preceding card will be held at a different angle with respect to the vertical card, all depending upon the dictates of the designer.

FIGS. 4 and 5 are action views showing the card holder 90 as it is being turned to change the card 70 being viewed. In FIG. 4 the one card 70A is approaching the vertical as the clockwise adjacent card 70B is falling towards its angled supported position. FIG. 5 shows card 70A being raised toward the vertical position with card 70B following the short portion 64 of abutment 62 toward the angled viewing position.

An improved point of sale flip card display device is shown and described that positively presents two cards for simultaneous viewing. The cards are supported at an angled relationship to each other for ease of viewing. The cards can be readily changed without the need for special tools or without removing the card holder 90 from the cabinet 16. The device is relatively inexpensive to manufacture and is substantially trouble-free from a maintenance and operational point of view.

As a modification, it is contemplated that the upper viewing opening may, in fact, be in a reclining plane such that the upper viewing card 70 will be supported only on the long portions 66 of the abutments with the top edge of the upper viewing card spaced rearward of the tab 88. Upon turning the card holder, the upper viewing card will engage with and snap past the tab 88 prior to pivoting forward into supporting relationship on the short portions 64 in the second viewing position.

I claim:

1. In a display device having a housing with a top wall, a bottom wall and a pair of side walls connected to said top wall and said bottom wall, said side walls having an upper portion with a vertically disposed forward edge and a lower portion with an angularly disposed forward edge extending from said vertically disposed edge toward a forward corner of said bottom wall, a vertically disposed opening defined by said vertically disposed edges and by a front edge of said top wall, and an angularly disposed opening defined by said angularly disposed forward edges and by a front edge of said bottom wall, card holder means bridging between said two side walls of said housing, an actuator connected through one of said walls and operatively engaging said card holder means, a plurality of equally spaced openings formed in each end portion of said card holder means with one opening in one end portion being aligned with one opening in the other end portion, said end portions of said card holder means are spaced apart discs in which said equally spaced openings are formed, a display card pivotally mounted in each pair of said aligned openings, abutment means formed on the outer edge of each end portion between each adjacent pair of openings in said end portions, said abutment means are formed on said discs between said adjacent pairs of openings with an abutment means on one disc aligned with an abutment means on the other disc, release means carried by the housing and extending into the path of movement of said display cards, indexing means on said card holder means coacting with a spring member on said housing for urging one abutment means in contact with one of said display cards for holding said card in engagement with said release means for viewing through said vertically disposed opening as a preceding card rests on one of said abutment means for viewing through said angularly disposed opening.

2. In a display device having a housing with a top wall, a bottom wall and a pair of side walls connected to said top wall and said bottom wall, said side walls having an upper portion with a vertically disposed forward edge and a lower portion with an angularly disposed forward edge extending from said vertically disposed edge toward a forward corner of said bottom wall, a vertically disposed opening defined by said vertically disposed edges and by a front edge of said top wall, and an angularly disposed opening defined by said angularly disposed forward edges and by a front edge of said bottom wall, card holder means bridging between said two side walls of said housing, an actuator connected through one of said walls and operatively engaging said card holder means, a plurality of equally spaced openings formed in each end portion of said card holder means with one opening in one end portion being aligned with one opening in the other end portion, a display card pivotally mounted in each pair of said aligned openings, abutment means formed on the outer edge of each end portion between each adjacent pair of openings in said end portions, each abutment means has intersecting planar portions, release means carried by the housing and extending into the path of movement of said display cards, indexing means on said card holder means coacting with a spring member on said housing for urging one planar portion of one abutment means in contact with one of said display cards for holding said card in engagement with said release means for viewing through said vertically disposed opening and the other planar portion of an adjacent abutment means forming the support for a preceding display card being viewed through said angularly disposed opening.

3. In a display device having a housing with a vertically disposed opening, card holder means bridging the opening, an actuator for turning said card holder means, said card holder means having a pair of spaced apart members, said members having a plurality of spaced openings formed therein for pivotally mounting a plurality of display cards in said members, said members having an abutment between each said spaced openings, each said abutment comprising a pair of angled portions mounted on said members between said spaced openings, indexing means on said card holder means and on said housing for urging one of said portions on said abutments against one display card for supporting said card in viewing position as the preceding card rests on another of said portions on the adjacent abutment.

4. In a display device, a housing having side walls, a top wall and a bottom wall, each side wall having a lower portion angled forwardly and downwardly from an upper portion thereof, said upper portions of said side walls defining a vertical opening and said angled lower portions of said side walls defining an angled opening, card holder means extending between said walls, an actuator shaft extending through one wall of said housing and engaging with said card holder means, said card holder means comprising a pair of spaced apart discs, each disc having a plurality of apertures therein, with each aperture in one disc having a mating aligned aperture in the order disc, an abutment between each adjacent pair of apertures, each abutment having two angularly disposed contact surfaces, said contact surfaces on the abutment on one disc aligning with corresponding contact surfaces on an aligned abutment on the other disc, detent means formed in at least one of said discs coacting with spring means on said housing for holding said card holder means in an indexed position in said housing, a display card pivotally mounted in each pair of aligned apertures in said discs, release means carried by the housing and extending from above into the confines of said vertical opening, said detent means positioning said card holder means with one abutment urging one card against said release means for exposing one face of said card through said vertical opening, a next preceding card engaging another contact surface of another abutment for exposing the back of said card through said angled opening, and means for rotating said shaft and said card holder means for snapping said vertical card past said release means and into said angled position in said angled opening as the next following card is urged into engagement in the vertical opening against said release means.

5. In a display device, a housing having a vertical opening and an angled opening, said housing having a pair of spaced apart side walls, card holder means extending between said side walls, an actuator shaft extending through one side wall of said housing and engaging with said card holder means, said card holder means comprising a pair of spaced apart discs, said discs having a plurality of means for pivotally supporting a plurality of cards therebetween, an abutment formed on each disc between each adjacent pair of pivotal supporting means, each abutment on one disc being aligned with one abutment on the other disc, each abutment having a first planar portion and a second planar portion intersecting each other, indexing means on said housing and on said card holder means for holding said card holder means in an indexed position in said housing, release means carried by the housing and extending into the confines of said vertical opening, said indexing means positioning said card holder means with the first planar portion of one abutment urging one card against said release means for exposing one face of said card through said vertical opening, a next preceding card engaging the second planar portion of another abutment for exposing the back of said card through said angled opening, and means for rotating said shaft and said card holder means for snapping said vertical card past said release means and into said angled position in said angled opening as the next following card is urged into engagement in the vertical opening against said release means.

6. In a display device having a housing with a vertically disposed opening, card holder means bridging the opening, an actuator for turning said card holder means, said card holder means comprising a pair of spaced apart members, said members having a plurality of circumferentially spaced means for pivotally mounting a plurality of display cards in said card holder means, an abutment on said members between each said circumferentially spaced means, each said abutment comprising a pair of planar portions angularly disposed with respect to each other, indexing means on said card holder means and on said housing for urging one of said planar portions of said abutments against one display card for supporting said card in viewing position as the preceding card rests on the other planar portion of the adjacent abutment.

7. In a display device as claimed in claim 3 wherein said indexing means comprises detents formed on the card holder means, and a spring mounted on said housing with one end portion engaging in one of said detents.

8. In a display device as claimed in claim 7 wherein release means are mounted on said housing in position to engage with one display card to hold said display card in viewing position, said release means comprises a tab extending from the housing into the path of movement of said cards.

* * * * *

UNITED STATES PATENT AND TRADEMARK OFFICE

CERTIFICATE OF CORRECTION

PATENT NO. : 4,102,070

DATED : July 25, 1978

INVENTOR(S) : Virgil S. Simon

It is certified that error appears in the above-identified patent and that said Letters Patent are hereby corrected as shown below:

Column 6, line 45, change "order" to --other--.

Column 6, line 45, after "abutment" insert --on the periphery of each disc--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*